US006052838A

United States Patent [19]

Thom et al.

[11] Patent Number: 6,052,838

[45] Date of Patent: Apr. 25, 2000

[54] TOILET SEAT AID

[75] Inventors: Paul Thom, Montclair; Kurt Landsberger, Verona; David Landsberger, Caldwell, all of N.J.; Alan Spiegel, Scarsdale, N.Y.

[73] Assignee: Bel-Art Products, Inc., Pequannock, N.J.

[21] Appl. No.: 09/104,709

[22] Filed: Jun. 25, 1998

[51] Int. Cl.[7] ..... A47K 13/00

[52] U.S. Cl. ..... 4/239; 4/235; 4/237

[58] Field of Search ..... 4/239, 237, 234, 4/235, 254, 238, 243.1

[56] References Cited

U.S. PATENT DOCUMENTS

| | | | |
|---|---|---|---|
| 2,568,322 | 9/1951 | Cunnungham | 4/239 |
| 3,153,248 | 10/1964 | Miller . | |
| 3,514,793 | 6/1970 | West . | |
| 4,133,061 | 1/1979 | Hurd | 4/239 |
| 4,153,957 | 5/1979 | Lifton . | |
| 4,214,323 | 7/1980 | Thomas | 4/239 |
| 4,461,046 | 7/1984 | Adams . | |
| 4,777,672 | 10/1988 | Gebhard et al. | 4/239 |
| 5,027,445 | 7/1991 | Locarno . | |
| 5,199,112 | 4/1993 | Locarno . | |
| 5,524,295 | 6/1996 | Ford | 4/239 |
| 5,765,236 | 6/1998 | Bethanis | 4/237 |
| 5,797,148 | 8/1998 | Kivela | 4/237 |

*Primary Examiner*—David J. Walczak
*Attorney, Agent, or Firm*—Lawrence G. Fridman

[57] ABSTRACT

A toilet seat aid consisting of a toilet seat aid body having a first sitting area and a second sitting area opposing each other. An operational opening is disposed substantially centrally within the seat body. The operational opening passes through the body, so as to interconnect the first and second sitting areas.

11 Claims, 9 Drawing Sheets

TOILET SEAT AID

FIELD OF THE INVENTION

The present invention generally relates to toilet accessories, and particularly to toilet seat aids adapted for use with conventional toilets.

BACKGROUND OF THE INVENTION

Toilet seats are typically disposed directly on the bowl of the toilet and designed to offer comfort to the user. Many modifications of toilet seats have been developed over the years. Although modified toilet seats may be adequate for some purposes, such seats have not been designed to accommodate in one unit the needs of nonwheelchair users inflicted with balance-affecting disorders or requiring some help in stabilizing themselves while also being useful to those individuals who are wheelchair bound.

There are multitudes of situations where it is difficult for a person to raise from or lower him/herself on a toilet seat. For others, the seat is too low and individuals do not have the ability to flex their hips far enough to place themselves into the required position. Some groups of elderly or infirm lack the stability to safely execute this necessary task. Another large and rapidly increasing group of the population having great difficulty in placing themselves on a toilet are the wheelchair users.

For transfer from a wheelchair to a toilet seat aid it is common to utilize a long sliding board having one end connected to the seat of the wheelchair and the other end resting on the toilet seat aid itself. In this condition, the wheelchair user usually grabs and pulls himself/herself over the board on the toilet. A significant problem may arise with this method in that the prior art toilet seat does not provide a sufficiently stable base for such sliding boards.

In addition, the conventional toilet seats often do not provide stationary elements helping individuals stabilize their position. It should be noted that the structure of a toilet seat can be an indispensable aid in resolving the above discussed problems.

Thus, it has been a long felt and unsolved need for a toilet seat arrangement capable of serving in one unit individuals requiring help in stabilizing themselves while seated and persons bound to a wheelchair. Furthermore, there has long been a need for a superimposed, raised toilet seat arrangement capable of serving individuals with balance-affecting disorders.

The design of a reversible toilet seat aid of one embodiment of the invention is capable of accommodating the needs of the first two categories of users. The toilet seat aid of another embodiment of the invention provides the raised superimposed toilet seat aid for individuals having difficulties in lowering and raising from conventional toilet seat aids and suffering from balance-affecting disorders.

SUMMARY OF THE INVENTION

One aspect of the present invention provides a toilet seat aid body having first and second sitting areas opposing each other and an operational opening disposed substantially centrally within said seat body. The operational opening passes through the body, so as to interconnect the first and second sitting areas. The receiving body has first and second sides situated symmetrically about a longitudinal axis of the body. A first supporting region is associated with the first side and a second supporting region is associated with a second side and each supporting region contains at least a hand grip extending outwardly from the first sitting area and at least one internal grasping handle extending through the body and situated in the vicinity of the hand grip.

The first and second supporting regions extend outwardly from planes of the first and second sitting areas, so as to define a first and second receiving recesses.

Another aspect of the invention provides a toilet seat aid adapted to be superimposed upon a conventional toilet bowl. This toilet seat aid includes a toilet seat aid body having a first sitting area and a second sitting area opposing each other with an operational opening disposed substantially centrally within the seat body. The operational opening passes through the body, so as to interconnect the first and second sitting areas. In the body the first and second sides are situated symmetrically about a longitudinal axis thereof. The first supporting region is associated with the first side and a second supporting region is associated with the second side. The first and second supporting regions have first and second raised hand grips extending outwardly therefrom. The first and second supporting regions extend outwardly from a plane of the first sitting area to define a first receiving recess. The first and second supporting regions extend outwardly from a plane of the second sitting area to define a second receiving recess.

According to a further aspect of the invention, in one operational mode, the first sitting area and the first receiving recess accommodate a toilet seat and a user in a sitting position and the periphery of the second receiving recess is adopted for closely receiving an upper rim of a toilet bowl. In another operational mode, the second sitting area and the second receiving recess accommodate a toilet seat and a user in a sitting position and the outer periphery of the first receiving recess is adapted to receive an upper rim of a toilet bowl. The first supporting region comprises a support surface spaced from the first sitting area by a first engaging wall and a base surface spaced from the second sitting area by a second engaging wall. The support and base surfaces extend in opposite directions relative to the operational opening and the first raised hand grip extends outwardly from the support surface of the first supporting region. The second supporting region comprises a support surface spaced from the first sitting area by a first engaging wall and a base surface spaced from the second sitting area by a second engaging wall. The support and base surfaces of the second supporting region extend in opposite directions from the operational opening and the second hand grip extends outwardly from the support surface of the second supporting region.

As to another aspect of the invention, each supporting region also includes at least one internal grasping handle extending between the corresponding support surface and the corresponding base surface in the vicinity of the corresponding hand grip. The first engaging walls of the first and second supporting regions define the outer periphery of the first receiving recess and the second engaging walls of the first and second supporting regions define the outer periphery of the second receiving recess. In one operational mode, the first receiving recess engages a toilet bowl in such a manner that the first engaging walls are positioned in the vicinity of an upper rim of the toilet bowl and in another operational mode the second receiving recess engages the toilet bowl in such a manner that the second engaging walls are positioned in the close vicinity of the upper rim of the toilet bowl.

Yet a further aspect of the invention provides a raised toilet seat aid adapted to be superimposed on a conventional toilet bowl. The toilet seat aid includes a toilet seat aid body with a sitting area, an operational opening disposed substantially centrally within the seat body and an engaging member extending downwardly from the operational opening.

BRIEF DESCRIPTION OF THE DRAWINGS

Other advantages and features of the invention are described with reference to exemplary embodiments, which are intended to explain and not to limit the invention and are illustrated in the drawings in which.

DETAILED DESCRIPTION OF THE PREFERRED EMBODIMENT

Figure 1:
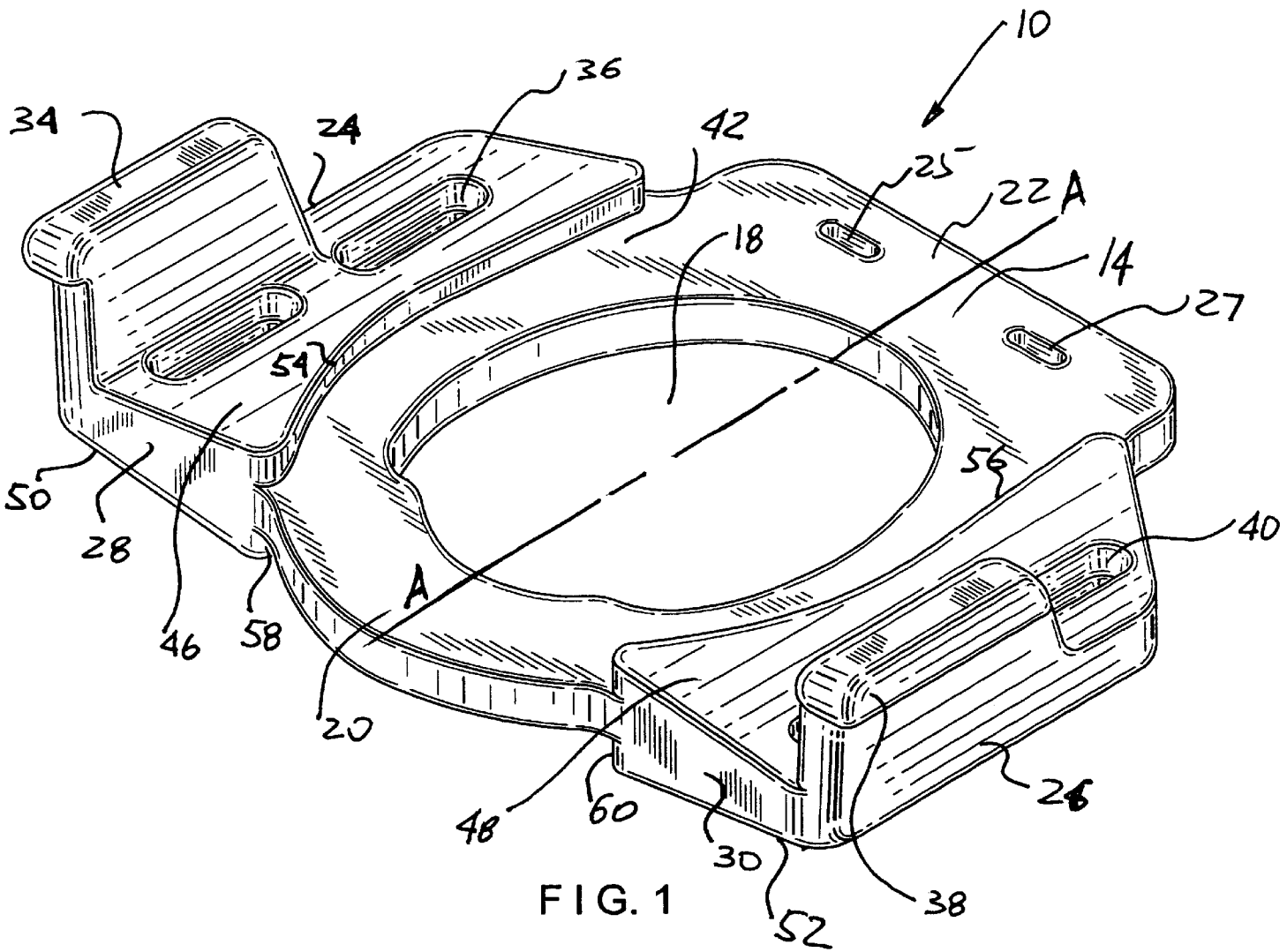
FIG. 1 is a top perspective view of one embodiment of the toilet seat aid according to my invention.

Referring now to FIGS. 1–6 and 9, 10 wherein one embodiment of the toilet seat aid 10 of the invention designed to fit domestic or commercial toilets is best illustrated. It is depicted in these figures that the toilet seat aid of the invention includes a first sitting area 14 and a second sitting area 16, opposing each other. An operational opening 18 is disposed substantially centrally and passes through the seat, so as to interconnect the first and second sitting areas. The toilet seat aid of the invention in one direction extends between a front part 20 and a rear part 22. In the other direction the seat aid extends between the first side 24 and the second side 26 which are symmetrically disposed about a longitudinal axis A-A extending in the front to rear direction. A first supporting region 28 is associated with the first side 24 and a second supporting region 30 is associated with the second side 26 of the toilet seat aid. The first supporting region 28 is formed with a first raised hand grip 34 and a set of first internal grasping handles 36. In a similar manner, the second supporting region 30 includes a second raised hand grip 38 extending outwardly therefrom and a set of second internal grasping handles 40. Although the first set and the second set may include any reasonable number of the internal handles, the toilet seat aid is typically formed with two internal handles passing through the corresponding supporting region.

Although the raised hand grips 34, 38 can extend through the entire length of an outer edge of the corresponding supporting region, in the preferred embodiment (for example, see FIGS. 1, 2 and 3) each raised hand grip extends from the front area along one internal grasping handle. In this arrangement, within the first sitting area 14, a generally flat unobstructed area is formed in each supporting region about the second internal handle situated remotely from the front part of the seat.

Figure 9:
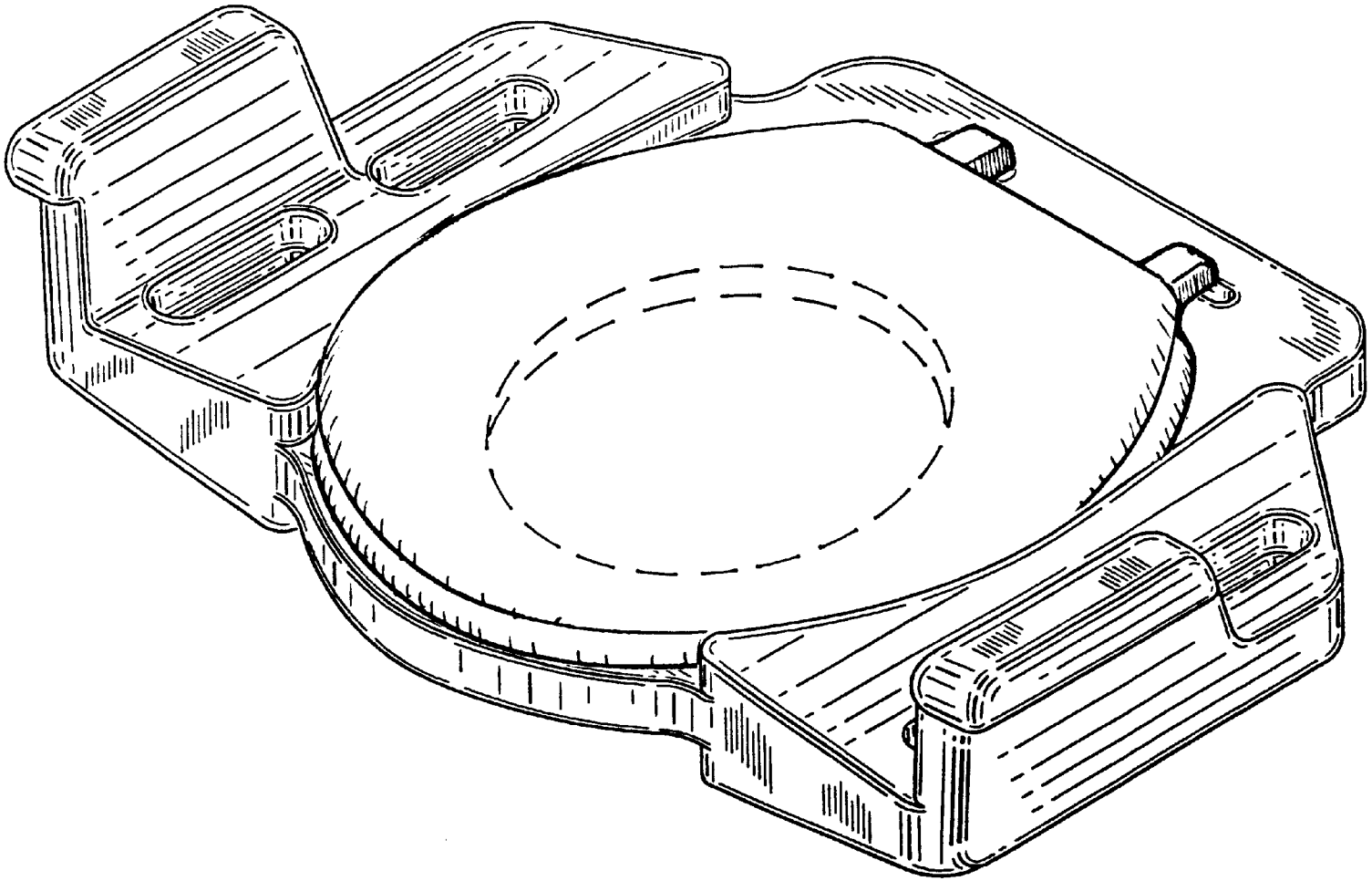
FIG. 9 is a top perspective view of FIG. 1 showing the toilet seat situated within the receiving recess.

As illustrated in at least FIGS. 1 and 9, the first and second supporting regions extend outwardly from a substantially flat plane of the first sitting area 14, so as to define a step-like structure on either side of the opening 18, ultimately forming a first receiving recess or an alternative receiving recess 42. It will be discussed below herein that in one operational mode of the invention, the first receiving recess 42 faces the upward direction and is adopted to accommodate a secondarily installed toilet seat (See FIGS. 4 and 9) and a user in a sitting position. However, when the toilet seat aid is utilized by an individual who does not wish to utilize the support of the raised hand grips or an individual using a wheelchair, the first sitting area and the first receiving recess face the downward direction of the toilet bowl. In this mode of operation, the first receiving recess 42 is adopted to receive and engage an upper rim of the toilet bowl. (see FIG. 6)

Figure 2:
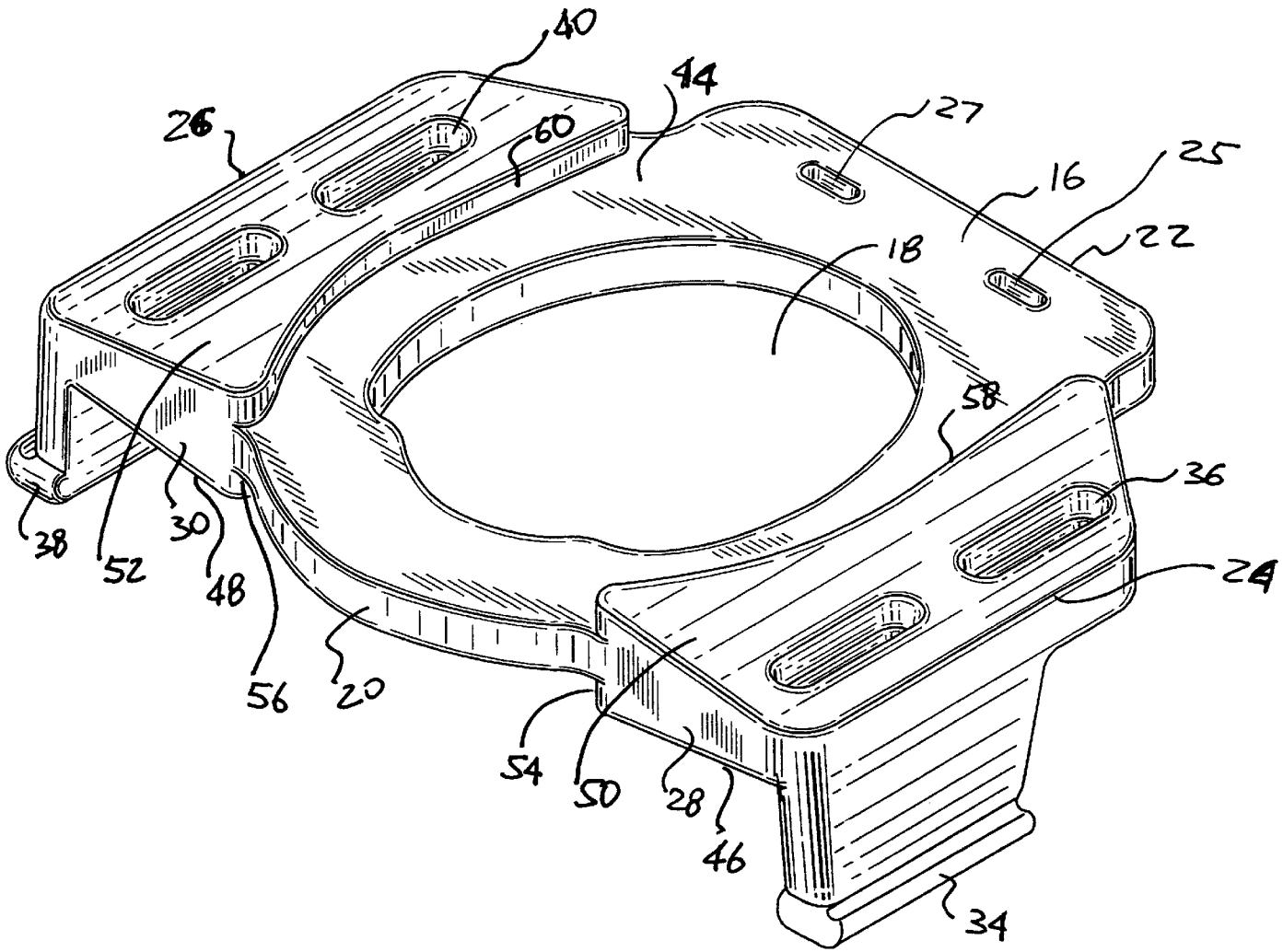
FIG. 2 is a bottom perspective view thereof.
Figure 3:
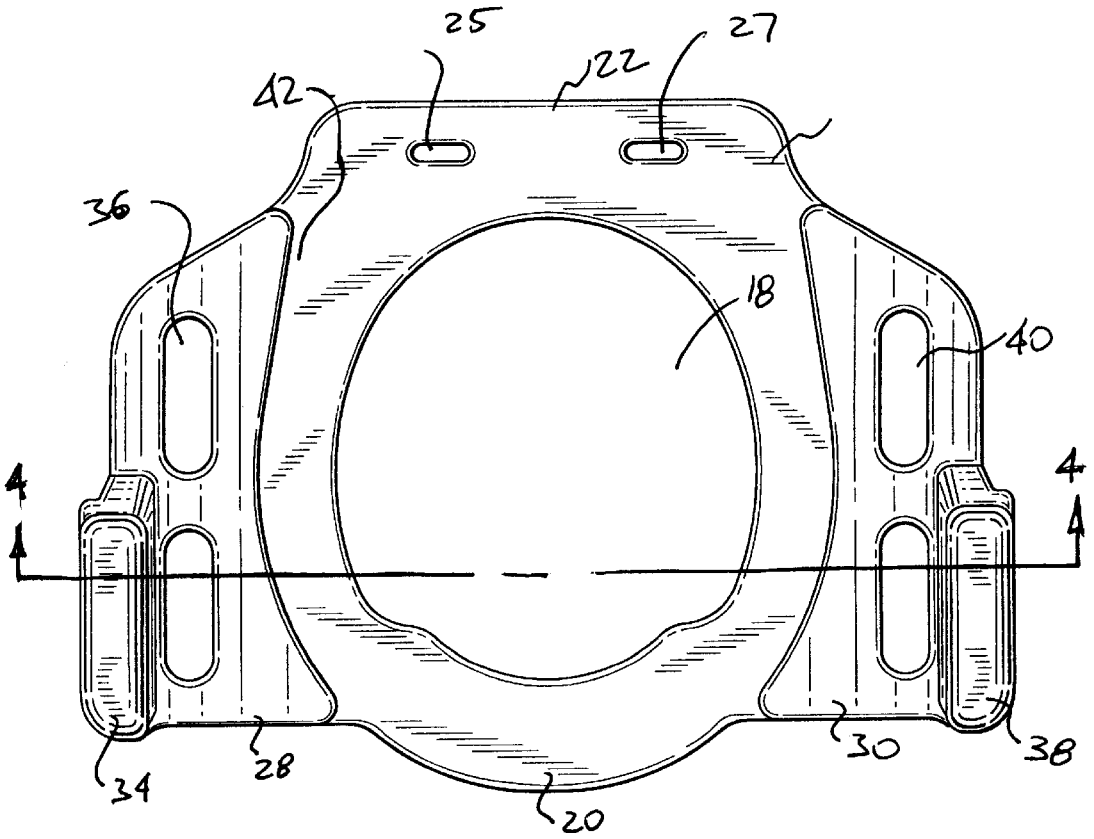
FIG. 3 is a top plan view thereof.

As best illustrated in at least FIG. 2, the level of the first and second supporting regions is spaced from a substantially flat plane of the second sitting area 16. In this manner a second receiving recess or a receiving recess 44 is formed. Upon utilizing the toilet seat aid of the invention by an individual requiring an unrestricted sitting area without raised hand grips or by a wheelchair user, the second sitting area 16 is positioned upwardly, so as to accommodate a toilet seat (see FIGS. 6 and 10) and a user in the sitting position. On the other hand, when the toilet seat aid of the invention is utilized by a person requiring help in stabilizing themselves, the second sitting area 16 is positioned downwardly and the second receiving recess 44 engages the upper rim of the toilet bowl (see FIGS. 4 and 9).

The first supporting region 28 is formed with a support surface 46 and a base surface 50 facing opposite directions. Similarly, the second supporting region 30 includes a support surface 48 and a base surface 52. The first hand grip 34 and the second hand grip 38 extend outwardly from the support surfaces 46 and 48, respectively. In the preferred embodiment of the invention, the area of the support surfaces 46 and 48 adjacent the seating recess 42 is substantially flat and substantially parallel to the plane of the first sitting area 14. In the vicinity of the front part 20 the support surfaces of both supporting regions are sloped towards the outside edges thereof.

Substantially vertical engaging walls 54 and 56 connect the support surfaces 46 and 48, respectively, with a substantially flat plane of the first sitting area 14. These engaging walls having a contour substantially repeating the curvature of the upper rim of a conventional toilet bowl and form an inseparable part of the first receiving recess 42. The plane of the base surface 50 of the first supporting region and the plane of the base surface 52 of the second supporting region taper toward the respective outer edges. Generally vertical engaging walls 58 and 60 are being curved so as to substantially repeat the configuration of the upper rim of a toilet bowl.

Figure 6:
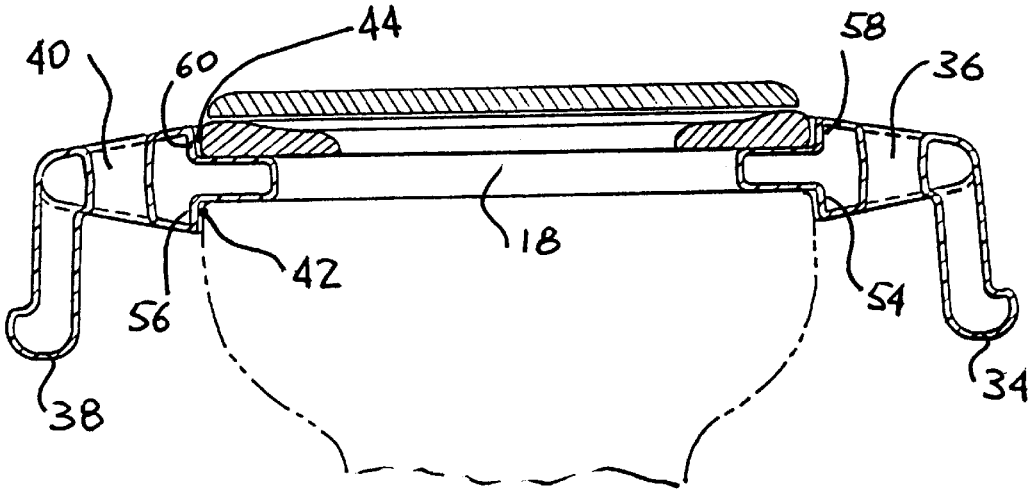
FIG. 6 is a cross-sectional view according to section line 6—6 of FIG. 5 showing a toilet seat.
Figure 5:
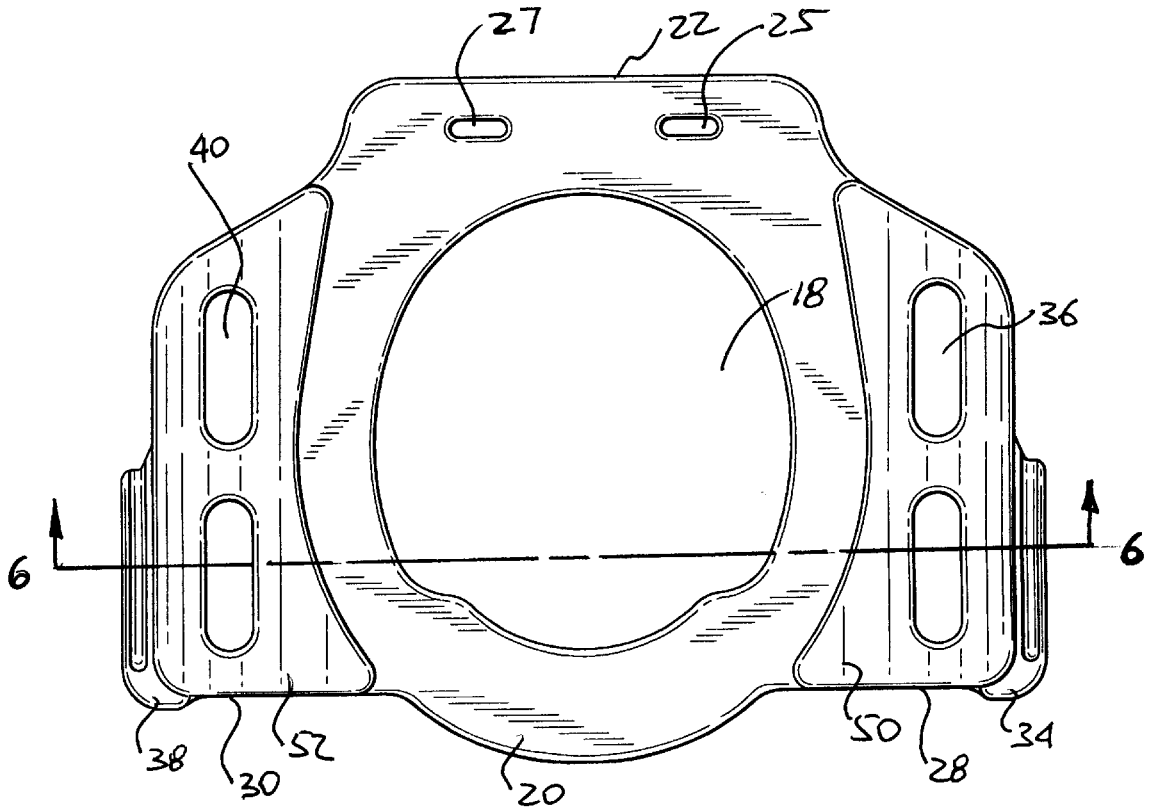
FIG. 5 is a bottom-plan view thereof.

In utilizing the toilet seat aid of the invention in one operational mode, the first sitting area 14 faces the toilet bowl and the upwardly oriented second receiving recess accommodates the toilet seat(see FIG. 6). In this mode of operation, upon engaging the first receiving recess 42 with an upper part of the toilet bowl, the substantially vertically positioned engaging walls 44 and 56 limit movement of the toilet seat aid relative to the toilet bowl in a horizontal direction.

Figure 4:
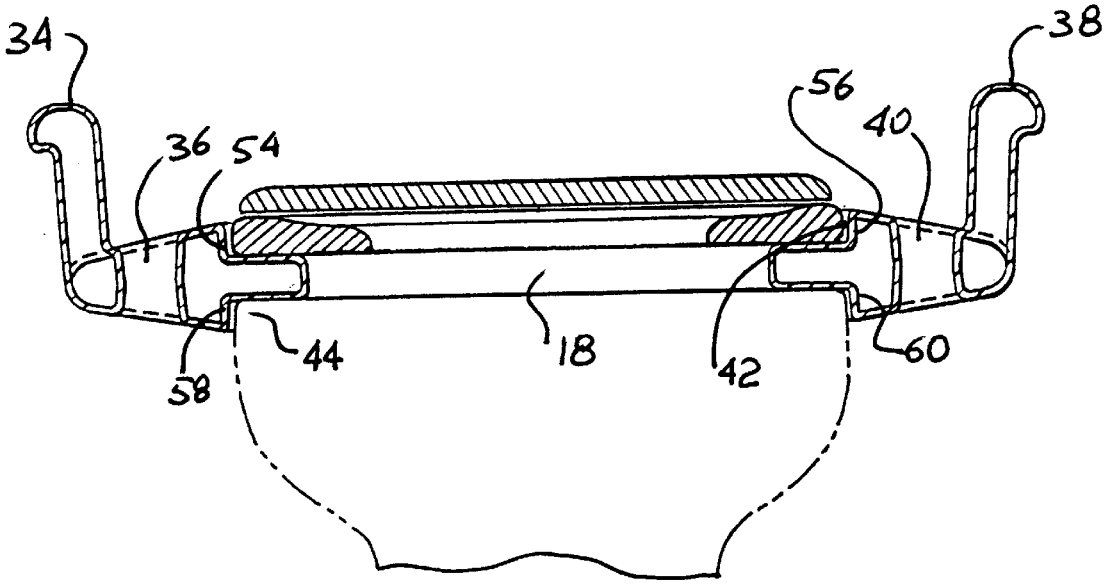
FIG. 4 is a cross-sectional view according to section line 4—4 of FIG. 3 showing a toilet seat.

In the other operational mode the second receiving recess 44 accommodates the upper rim of a toilet bowl and the engaging walls 58 and 60 limit horizontal motion of the toilet seat aid about the toilet seat bowl(see FIG. 4). In this position, a toilet seat engages the first receiving recess 42.

Figure 7:
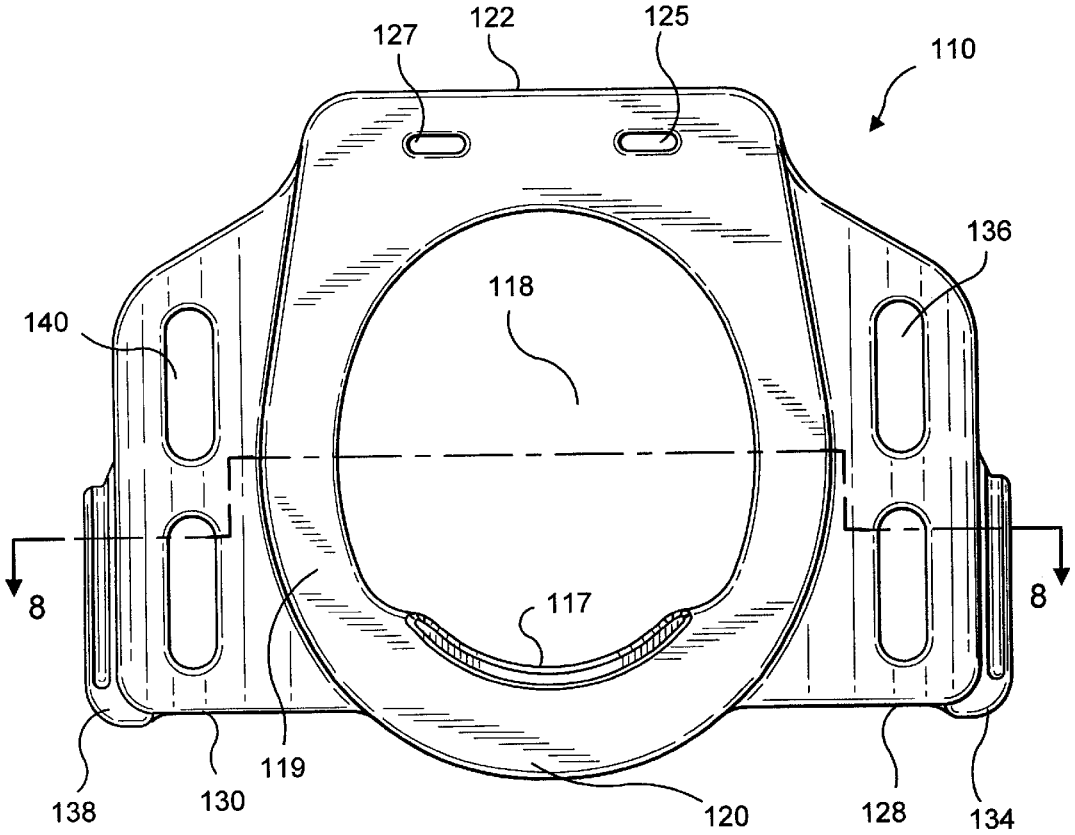
FIG. 7 is a bottom plan view of another embodiment of the invention.
Figure 8:
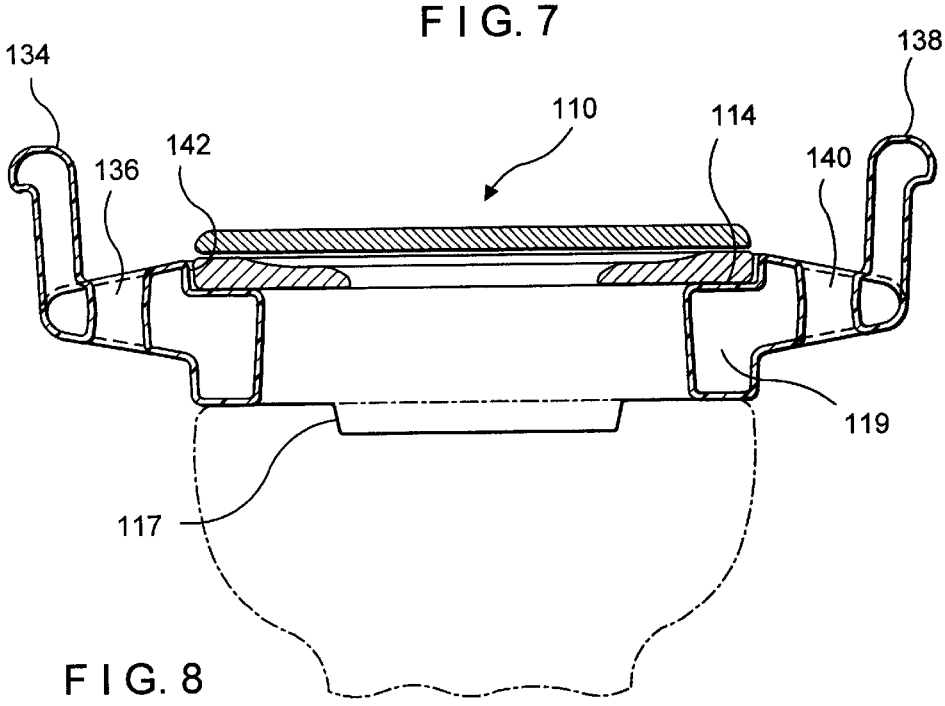
FIG. 8 is a reversed cross-sectional view according to section line 8—8 of FIG. 7 showing a toilet seat.

Another embodiment of the invention containing a raised superimposed toilet seat aid 110 adapted to fit domestic and commercial toilets is best illustrated in FIGS. 7 and 8. The seat is formed to be disposed on top of a conventional toilet bowl and comprises an annular body 119 of substantially increased height defining the centrally positioned operational opening 118 corresponding to the opening of the toilet bowl. The opening 118 is generally oval in shape. The upper portion of the body 119 is similar to the above discussed first sitting area 14 and the first receiving recess 42. In this respect, the first supporting region 128 includes a first raised hand grip 134 and a set of first internal grasping handles 136. The second supporting region 130 includes the second raised hand grip 138 and a set of second internal grasping handles 140. The first and second supporting regions are spaced above a substantially flat plane of the sitting area 114 to define a step-like receiving recess 142 adopted to accommodate a secondarily installed toilet seat and a user in a sitting position.

As illustrated in FIGS. 7 and 8, the bottom part of the toilet seat aid 110 has an engaging portion 117 extending downwardly from a front part of the opening 118. The exterior of the engaging portion 117 is extended into the interior of a toilet bowl while the seat rests on a top thereof. It should be obvious to a person of ordinary skill in the present art that the engaging portion can be disposed circumferentially through the interior of the opening 118. However, in the preferred embodiment (as illustrated in FIG. 7) the engaging portion has a curved configuration and is limited to the front area of the opening.

In the assembled condition, the engaging portion fits into a toilet bowl while the seat aid 110 rests on top of the toilet. In view of the increased thickness of the toilet seat aid body (see FIGS. 8 and 9) the level of the sitting area 114, the receiving recess 142 with a toilet seat and ultimately the level of the user in sitting position is elevated. This facilitates utilization of the toilet by disabled individuals, post-surgical patients and others having difficulties in sitting on and raising from the toilet seat aid having conventional height.

The toilet seat aid of the invention may be configured having a closed front design usually associated with domestic usage or a horseshoe configuration with an open front (not shown) typically used in commercial applications.

The rear portion of the toilet seat aid of the invention can be formed with at least a pair of holes or slots 25, 27, (125, 127) to accommodate fixtures adapted for securing the invention to the secondarily installed toilet seat and to the toilet bowl (see FIG. 9), so as to provide additional safety and stability to the users.

In utilizing a non-wheelchair mode of operation of the toilet seat aid 10, as illustrated on at least FIGS. 4 and 9, the first sitting area 14 and the first receiving recess 42 face the upward direction, so as to accommodate the secondarily installed toilet seat and a user in the sitting position. The second receiving recess 44 engages the upper rim of the toilet bowl. In this condition, the first and second raised hand grips 34, 38 as well as the internal grasping handles 36, 40 associated with both supporting regions are exposed to the user. In this operational mode, the raised hand grips can be utilized by elderly, disabled or any other person experiencing tremors or instability while raising from or lowering him/herself on the toilet seat aid. The user has the option of utilizing either the raised hand grips or the internal handles or both to enhance their own stability. The internal handles 36, 40 also enable the user to combat problems associated with bowel movement and constipation.

Figure 10:
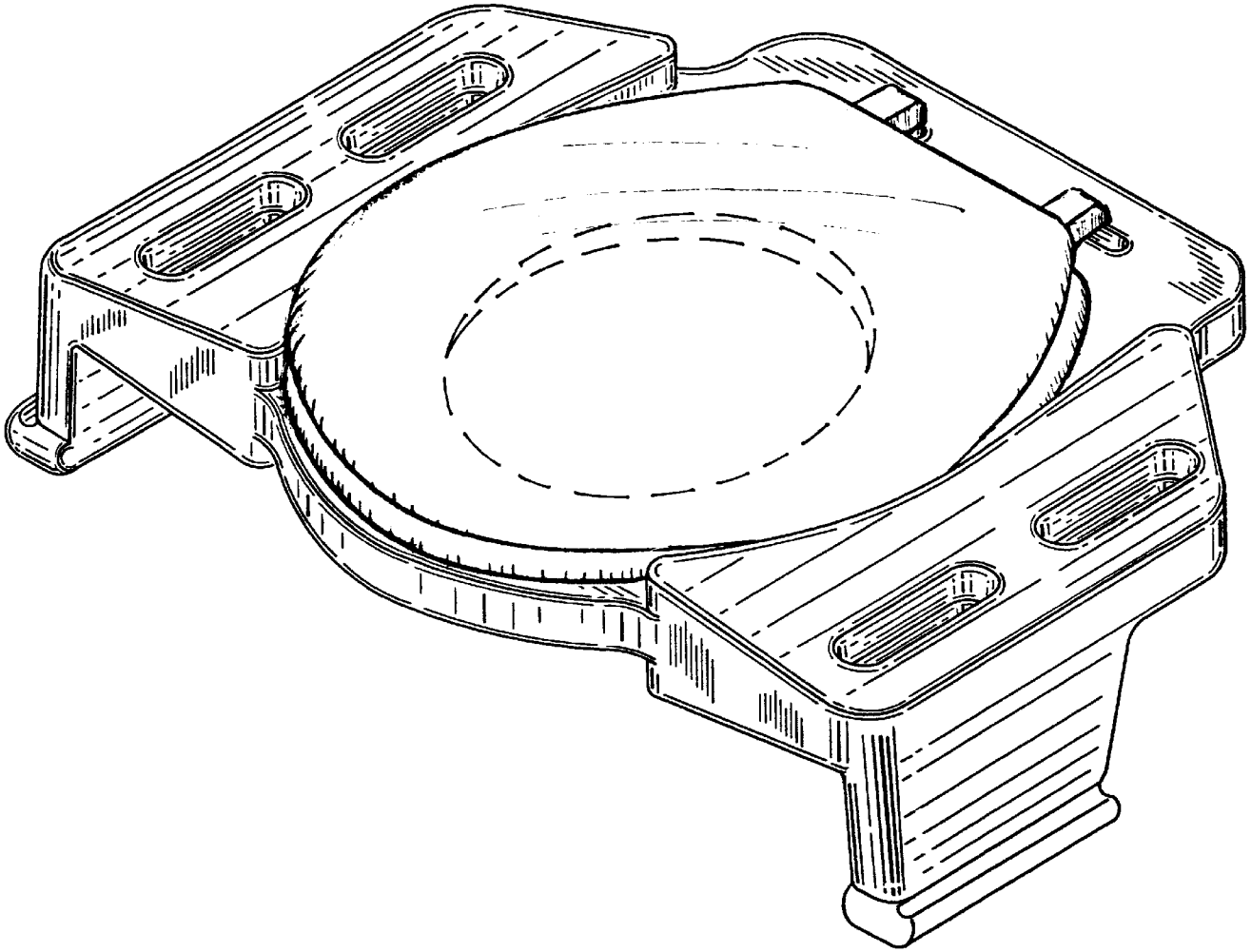
FIG. 10 is a bottom perspective view of FIG. 2 showing the toilet seat positioned within the receiving recess.
Figure 11:
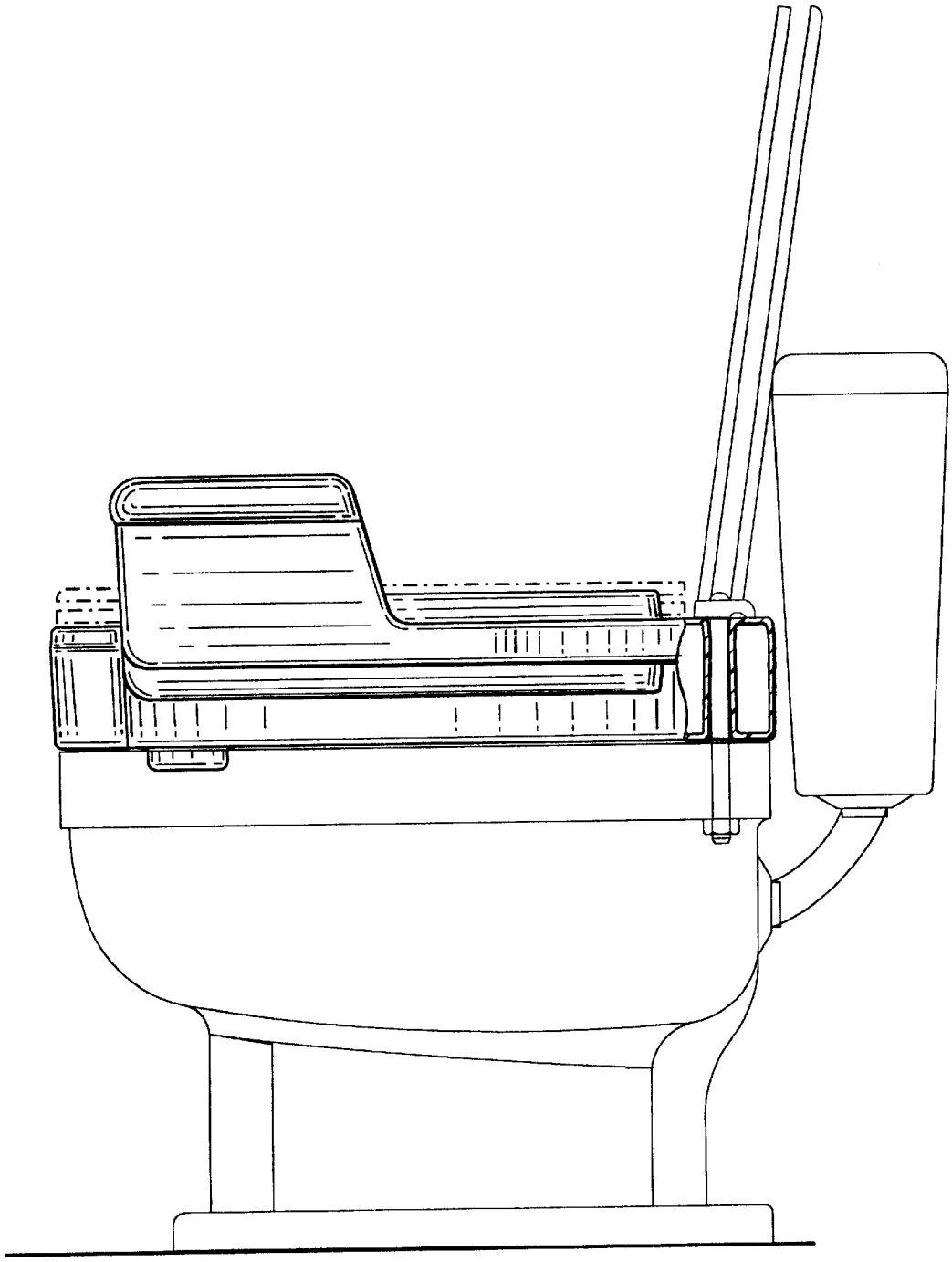
FIG. 11 shows the raised toilet seat aid of FIGS. 7 and 8 connected to a toilet.

When the toilet seat aid 10 of the invention is positioned for operation by a wheelchair user or any person requiring an unrestricted sitting area, as illustrated in at least FIGS. 6 and 10, the second sitting area 16 and the second receiving recess 44 are positioned upwardly and the downwardly oriented first receiving recess 42 engages the upper rim of the toilet seat bowl. In this mode, the wheelchair user utilizes the internal handles 36 and 40 to transfer himself/herself from a wheelchair to a toilet. The internal handles also enable the users to improve their stability while sitting on the toilet.

The operation of the raised superimposed toilet seat aid 110 is similar to the operation of the above discussed non-wheelchair mode. Thus, the user is not only elevated in the sitting position but also can utilize the raised hand grips and/or the internal grasping handles to improve stability.

What is claimed is:

1. A toilet seat aid comprising:

a toilet seat aid body, said body having a first sitting area and a second sitting area opposing each other, an operational opening disposed substantially centrally within said seat body, said operational opening passing through said body so as to interconnect said first and second sitting areas;

said body having first and second sides situated substantially symmetrically about a longitudinal axis of the body and extending in a front to rear direction, a first supporting region associated with the first side and a second supporting region associated with the second side; each said supporting region having at least a raised hand grip extending outwardly from portions of said regions associated with said first sitting area; and said first and second supporting regions extend outwardly from a plane of said second sitting area so as to define a receiving recess.

2. The toilet seat aid of claim 1, wherein said first and second supporting regions extend outwardly from a plane of said first sitting area so as to define an alternative receiving recess.

3. The toilet seat aid of claim 1, wherein each said supporting region further comprises at least one internal grasping handle extending therethrough and situated in the vicinity of said raised external handle.

4. A toilet seat aid adapted to be superimposed upon a conventional toilet bowl, comprising:

a toilet seat aid body, said body having a first sitting area and a second sitting area opposing each other and adapted to accommodate a toilet seat, an operational opening disposed substantially centrally within said seat body, said operational opening passing through said body so as to interconnect said first and second sitting areas;

said body having first and second sides situated symmetrically about a longitudinal axis of the body and extending in a front to rear direction, a first supporting region associated with the first side and a second supporting region associated with the second side; said first and second supporting regions having first and second raised hand grips, respectively, extending outwardly therefrom; and said first and second supporting regions extend outwardly from a plane of said second sitting area to define a receiving recess.

5. The toilet seat aid of claim 4, said first and second supporting regions extend outwardly from a plane of said first sitting area to define an alternative receiving recess.

6. The toilet seat aid of claim 5, wherein in one operational mode said first sitting area and said alternative receiving recess accommodate a toilet seat and a user in a sitting position and an inner periphery of said receiving recess is adapted for close receiving an upper rim of a toilet bowl.

7. The toilet seat aid of claim 6, wherein in another operational mode said second sitting area and said receiving recess accommodate a toilet seat and a user in a sitting position and an inner periphery of said alternative receiving recess is adapted to receive an upper rim of a toilet bowl.

8. The toilet seat aid of claim 5, wherein said first supporting region comprises a support surface spaced from said first sitting area by a first engaging wall and a base surface spaced from said second sitting area by a second engaging wall, said support and base surfaces face in opposite directions relative to said operational opening, said first raised hand grip extends outwardly from said support surface of the first supporting region; and said second supporting region comprises a support surface spaced from said first sitting area by a first engaging wall and a base surface spaced from said second sitting area by a second engaging wall, said support and base surfaces of the second supporting region face in opposite directions from said operational opening, said second raised hand grip extends outwardly from said support surface of the second supporting region.

9. The toilet seat aid of claim 8, wherein each said supporting region further comprises at least one internal grasping handle extending between the corresponding support surface and the corresponding base surface in the vicinity of the corresponding raised hand grip.

10. The toilet seat aid of claim 8, wherein said first engaging walls of said first and second supporting regions define an outer periphery of said alternative receiving recess and said second engaging walls of said first and second supporting regions define an outer periphery of said receiving recess.

11. The toilet seat aid of claim 10, wherein in one operational mode said alternative receiving recess engages a toilet bowl in such a manner that said first engaging walls are positioned in a vicinity of an upper rim of the toilet bowl; and in another operational mode said receiving recess engages said toilet bowl in such a manner that said second engaging walls are positioned in a vicinity of the upper rim of the toilet bowl.

* * * * *